United States Patent [19]

Tamaru et al.

[11] Patent Number: 4,595,812

[45] Date of Patent: Jun. 17, 1986

[54] CIRCUIT INTERRUPTER WITH DETACHABLE OPTIONAL ACCESSORIES

[75] Inventors: Shigemi Tamaru; Kiyomi Yamamoto, both of Fukuyama, Japan

[73] Assignee: Mitsubishi Denki Kabushiki Kaisha, Japan

[21] Appl. No.: 652,627

[22] Filed: Sep. 20, 1984

[30] Foreign Application Priority Data

Sep. 21, 1983 [JP] Japan ..... 58-175896

[51] Int. Cl.[4] ..... H01H 45/02; H01H 45/08

[52] U.S. Cl. ..... 200/307; 200/153 T; 335/132

[58] Field of Search ..... 200/293, 303, 307, 153 T, 200/153 SC, 153 G, 153 H; 335/132; 337/207, 186, 187, 201; 174/52 R

[56] References Cited

U.S. PATENT DOCUMENTS

| | | | |
|---|---|---|---|
| 3,116,388 | 12/1960 | Hobson, Jr. | 337/173 |
| 3,340,375 | 9/1967 | Kiesel et al. | 200/153 T |
| 4,356,368 | 10/1982 | Osika | 200/307 |
| 4,393,283 | 7/1983 | Masuda | 200/307 X |
| 4,485,365 | 11/1984 | Lerude et al. | 335/132 |
| 4,539,541 | 9/1985 | Bharteey et al. | 335/132 |

FOREIGN PATENT DOCUMENTS

| | | | |
|---|---|---|---|
| 1535875 | 12/1978 | United Kingdom | 200/307 |

OTHER PUBLICATIONS

"Moulded Case Circuit Breakers", 1974, published by Square D Limited.

"AB De-Ion Circuit Breakers", p. 9, 1974, published by Westinghouse Electric Corporation.

*Primary Examiner*—Stephen Marcus

*Assistant Examiner*—Ernest G. Cusick

*Attorney, Agent, or Firm*—Leydig, Voit & Mayer, Ltd.

[57] ABSTRACT

A circuit interrupter comprises a housing including a housing wall, an interrupting mechanism including a pair of separable contacts and an operating mechanism, and an optional accessory unit used in connection with an opening operation of the interrupting mechanism. The optional accessory unit may be a unit which includes a movable member operable in connection with the opening operation of the interrupting mechanism, such as an alarm switch, an auxiliary switch, a voltage trip device or an under voltage trip device. The optional accessory unit may be a connecting terminal block connectable between an external circuit and the circuit interrupter. The housing has formed in the outer surface thereof a receptacle cavity for receiving therein the optional accessory unit. When the unit is received in the cavity, no substantial portion of the unit projects from the housing. A fastening means comprises a slider, a guide rail engaging the slider for allowing a sliding movement of the optional accessory unit only in the direction of extension of the guide rail, and a screw for securing the optional accessory unit to the housing wall.

10 Claims, 5 Drawing Figures

CIRCUIT INTERRUPTER WITH DETACHABLE OPTIONAL ACCESSORIES

FIELD OF THE INVENTION

This invention relates to circuit interrupters, and more particularly to circuit interrupters with detachable optional accessories.

DESCRIPTION OF THE PRIOR ART

A circuit interrupter to which one or more detachable auxiliary units or one or more optional accessory unit can be incorporated in order to extends the function of the circuit interrupter is known. One example of such circuit interrupter with detachable optional accessory units is disclosed in U.S. Pat. No. 3,116,388, in which a solenoid is provided for the purpose of permitting a remote actuation of the trip bar. When the solenoid is energized, a plunger of the solenoid pushes the plunger of the trip unit to rotate the trip bar in the contact opening direction. Other examples are disclosed in a brochure entitled "Moulded Case Circuit Breakers", 1974, published by Square D Limited, a British Company, and a brochure entitled "AB De-ion Circuit Breakers", page 9, 1974, published by Westinghouse Electric Corporation. The circuit interrupters disclosed in these prior references have an internal space within the moulded housing for receiving in the space various optional accessories. Since the optional accessories are installed within the moulded housing, the housing must be opened by removing a housing cover from a housing base when the optional accessories are to be mounted or dismounted. When the housing cover is removed from the base, the entire interrupting mechanism is exposed and the ingress of any foreign matter and the falling off of interrupter components may occur. Also, since the optional accessories are installed within the housing and have no cover or housing, the installed accessories are exposed to a high temperature arced gas generated between the separating contacts upon a current interruption.

SUMMARY OF THE INVENTION

Accordingly, an object of the present invention is to provide a circuit interrupter with detachable optional accessory units in which the attaching and detaching of the optional accessory unit can be simply and quickly achieved.

Another object of the present invention is to provide a circuit interrupter with detachable optional accessory units in which the optional accessory unit is not exposed to a high temperature arced gas within the moulded housing of the circuit interrupter.

Still another object of the present invention is to provide a circuit interrupter with detachable optional accessory units in which the optional accessory unit is not projected from the circuit interrupter main body.

With the above objects in view, a circuit interrupter of the present invention comprises a housing including a housing wall, an interrupting mechanism disposed within the housing and including a pair of separable contacts and an operating mechanism for opening and closing the separable contacts, and a first optional accessory unit used in connection with an opening operation of the interrupting mechanism. The first optional accessory unit may be a unit which includes a movable member operable in connection with the opening operation of the interrupting mechanism, such as an alarm switch, an auxiliary switch, a voltage trip device or an under voltage trip device. Alternatively, the first optional accessory unit may be a connecting terminal block for connecting an external electrical circuit to the interrupting mechanism of the circuit interrupter.

The housing has formed in the outer surface of the housing wall a receptacle cavity for receiving therein the first optional accessory unit. When the first optional accessory unit is received in the receptacle cavity, the first optional accessory unit has no substantial portion that projects from the outer surface of the housing wall.

The fastening means comprises a slider disposed on either one of the optional accessory unit and the housing wall, a guide rail disposed on the other of the optional accessory unit and the housing wall and engaging the slider for allowing a sliding movement of the optional accessory unit only in the direction of extension of the guide rail, and means for preventing the sliding movement of the optional accessory unit relative to the housing wall.

BRIEF DESCRIPTION OF THE DRAWINGS

The present invention will become more readily apparent from the following description of the preferred embodiments of the present invention taken in conjunction with the accompanying drawings, in which.

DESCRIPTION OF THE PREFERRED EMBODIMENTS

Figure 1:
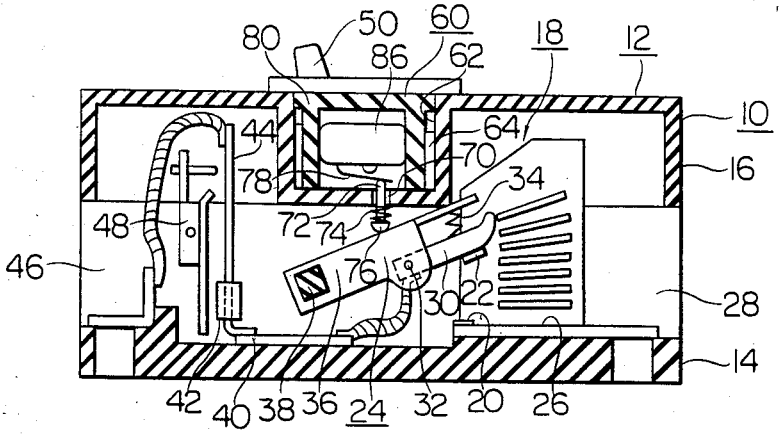
FIG. 1 is a sectional view of a circuit interrupter of the present invention.

FIG. 1 illustrates in a sectional view a circuit interrupter 10 constructed in accordance with the present invention. The circuit interrupter 10 comprises a moulded housing 12 of an insulating material comprising a base 14 and a cover 16 and an interrupting mechanism 18 disposed within the housing 12. The interrupting mechanism 18 housed in the housing 12 comprises a pair of separable contacts 20 and 22, and an operating mechanism 24 for opening and closing the separable contacts 20 and 22. The contact 20 is stationary and is mounted on one end of a conductor 26, the other end of which is connected to a load side terminal 28. The contact 22 is a movable contact carried by a movable contact arm 30 pivotally supported by a pin 32 and a compression spring 34 on an electrically insulating movable arm 36. The insulating movable arm 36 is rigidly supported on a cross bar 38 extending across three pole units of the circuit interrupter for the simultaneous opening and closing operation of the contacts in the respective poles. The movable contact arm 30 is electrically connected through a conductor 40 to an electromagnetic trip device 42 and a bimetallic thermal trip device 44. The thermal trip device 44 is connected to a source side terminal 46. The electromagnetic trip device 42 and the thermal trip device 44 are arranged, when actuated, to rotate a trip bar 48 which extends across three pole units and which releases a latched releasable member such as a cradle (not shown) of the operating mechanism disposed in the central pole unit of the circuit interrupter 10. The operating mechanism of the central pole unit further includes an operating handle 50 for manual operation.

Figure 2:
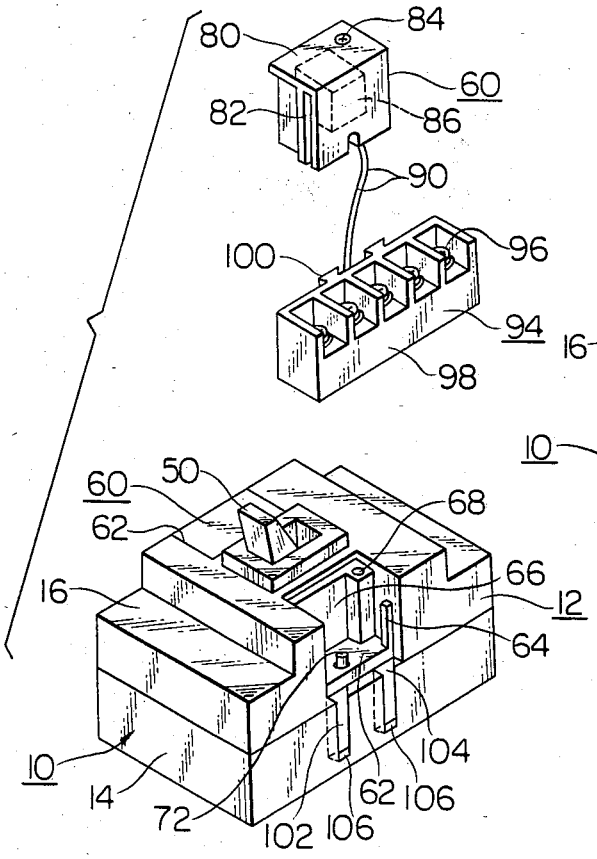
FIG. 2 is an exploded perspective view of one embodiment of the circuit interrupter of the present invention in which a first and second optional accessory units are detached from the interrupter housing.

The circuit interrupter of the present invention further comprises a first optional accessory unit 60 used in connection with the opening operation of the interrupting mechanism 18 of the circuit interrupter 10. In the illustrated example, the first optional accessory unit 60 is a contact device or an auxiliary switch which is switched upon the interruption of the circuit interrupter mechanism 18. It is seen that the first optional accessory unit 60 is received in a cavity 62 formed in the cover 16 of the housing 12, in such a manner that there is no substantial portion that projects from the outer surface of the housing wall of the housing 12. As best seen in FIG. 2, the housing wall defining the cavity 62 of the housing 12 has formed on the inner surface of the wall defining the cavity 62 a pair of elongated ridges or projections 64 which function as a pair of guide rails, a land portion 66 including a threaded hole 68, and a through hole 70 within which an operating rode 72 is disposed. The operating rod 72 is axially movably supported within the through hole 70 and spring biased by a compression spring 74 mounted between the housing wall and an enlarged head 76 formed on the inner end of the operating rod 72. The inner end or the head 76 of the operating rod 72 is in engagement with the back side of the insulating movable arm 36 of the movable contact assembly 24, and the outer end of the operating rod 72 projects into the cavity 62 with which the first optional accessory unit 60 is to be received.

The first optional accessory unit 60 of the illustrated example comprises an accessory housing 80 which has no projecting portion projecting from the outer surface of the circuit interrupter housing 12 when received in the cavity 62. The accessory housing 80 also has formed at the position corresponding to the elongated projections 64 a pair of guide grooves 82 which are guided slidably along the elongated projections 64 on the circuit interrupter housing 12. Therefore, the first optional accessory unit 60 can be inserted into the cavity 62 in the direction of the extension of the projections 64 while being prevented from moving in other directions. In order to prevent the first optional accessory unit 60 from being pulled out from the accessory cavity 62, a screw 84 is provided in the accessory housing 80 for engaging the threaded hole 68 formed in the land portion 66 of the cavity 62. In the illustrated example, the first optional accessory unit 60 comprises within the housing 80 a micro switch 86 having an actuating lever 78 which is contacted with the outer end of the operating rod 72. The micro switch 86 has a pair of lead wires 90 extending through the accessory housing 80 for a direct electrical connection to an electrical device (not shown) to be switched on or off by the micro switch 86.

Alternatively, a terminal block 94 as shown in FIG. 2 may be used to connect the optional accessory unit 60 to the unillustrated electrical device to be associated with the optional accessory unit 60. It is to be noted that since the terminal block 94 is an option and used in connection with the opening operation of the interrupting mechanism 18 of the circuit interrupter 10, the terminal block 94 can be referred to as a second optional accessory unit. The terminal block 94 has a plurality of connectors 96 mounted on an electrically insulating body 98. The insulating body 98 has on its back side a pair of dove-tails 100 which slidably engage the complementary-shaped grooves 102 formed in the base 14 of the circuit interrupter housing 12. The grooves 102 extend from the top surface of the base 14 at 104 and terminate at 106 before they reach the bottom surface of the base 14, so that the dove-tails 100 on the terminal block 94 can be inserted in the grooves 102 through the open upper ends 104 until they are stopped by the lower ends 106.

Figure 3:
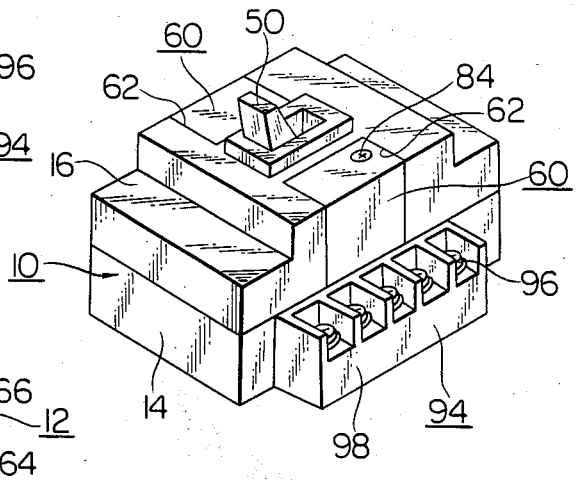
FIG. 3 is a perspective view of the circuit interrupter shown in FIG. 2 in which the optional accessary units are attached on the housing wall.

When it is desired to use the optional accessory unit 60 together with a second optional accessory unit such as the terminal block 94, the terminal block 94 is first attached to the housing 12 by sliding the dove-tails 100 into the grooves 102 from the open upper ends 104 until the lower ends of the dove-tails 100 abut against the closed lower ends of the grooves 102. Then the first optional accessory 60 is slid along the elongated projections 64 and secured by the screw 84 threaded into the threaded hole 68, thereby preventing the optional accessory units 60 and 94 from being pulled out from the cavity 62. FIG. 3 illustrates the circuit interrupter 10 with the optional accessory units 60 and 94 attached on the outer surface of the housing wall 12.

Figure 4:
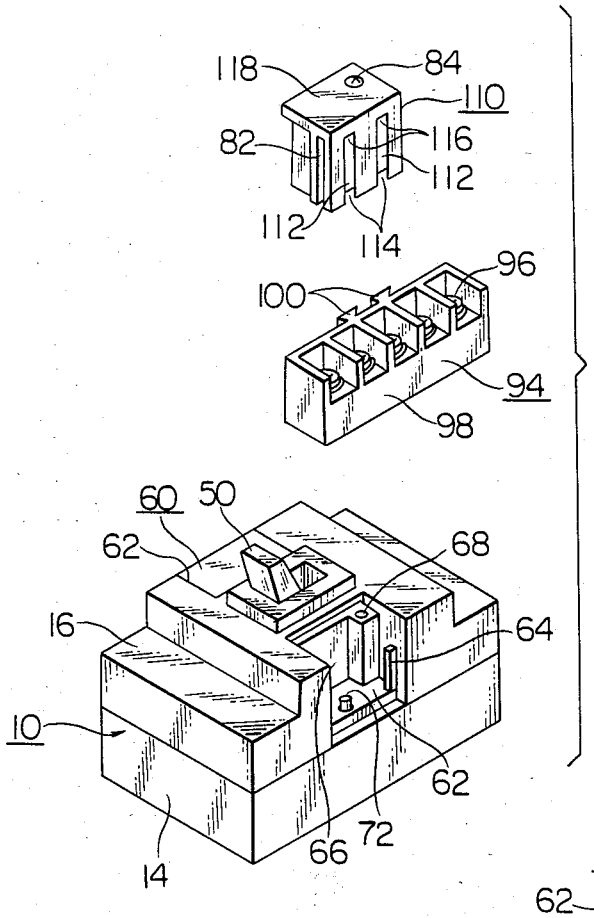
FIG. 4 is an exploded perspective view of another embodiment of the circuit interrupter of the present invention in which a first and second optional accessory units are detached from the interrupter housing.
Figure 5:
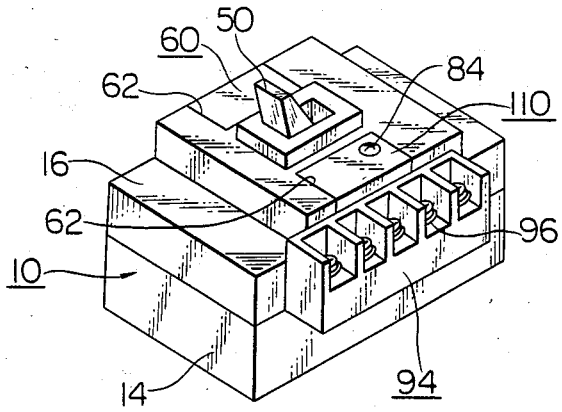
FIG. 5 is a perspective view of the circuit interrupter shown in FIG. 4 in which the optional accessary units are attached on the housing wall.

FIGS. 4 and 5 illustrate another embodiment of the present invention in which the terminal block 94 is attached to the housing of the first optional accessory unit 110. In this embodiment, grooves 112 open at the lower ends 114 and closed at the upper ends 116 for receiving the dove-tails 100 of the terminal block 94 are formed in the housing 118 of the unit 110. Accordingly, the base 14 of the circuit interrupter housing 12 is not provided with grooves for receiving the dove-tails. In the assembled state shown in FIG. 5, the terminal block 94 is attached to the first optional accessory unit 110. In other respect, the arrangement is similar to that previously described in conjunction with the embodiment shown in FIGS. 1 to 3.

Although the description has been made in terms of a first and second optional accessory units 60 and 94 which are an auxiliary switch (AX) and a terminal block, respectively, the optional accessory units used in connection with the circuit interrupter may include an alarm switch (AL), a voltage trip device (SHT), and/or an undervoltage trip device (UVT). These optional accessory units can be used in combination or solely in accordance with the necessity. It is also to be noted that the terminal block 94 may be used as a first optional accessary unit independently of other optional accessory units, in which case electrical wires extend through the housing wall of the circuit interrupter housing and operatively connect the terminal block and the interrupting mechanism of the circuit interrupter.

The alarm switch may be arranged to be actuated by a cradle or a releasable member of the operating mechanism of the circuit interrupter to energize an alarm such as an alarm lamp. The alarm switch may be of similar construction as the auxiliary switch unit 60. The voltage trip device and the undervoltage trip device may be electromagnetic solenoids energized in response to an electrical signal. When actuated, a plunger or armature of the solenoid causes the trip bar of the interrupting mechanism of the circuit interrupter to rotate to trip open the circuit interrupter.

What is claimed is:

1. A circuit interrupter comprising:

a housing including a housing wall;

an interrupting mechanism disposed within said housing and including a pair of separable contacts and an operating mechanism for opening and closing said separable contacts;

a first optional accessory unit used in connection with an opening operation of said interrupting mechanism, which said first optional accessory unit includes a movable member operable in connection with the opening operation of said interrupting mechanism;

fastening means for detachably fastening said first optional accessory unit to an outer surface of said housing wall of said housing; and connecting means comprising an operating rod movably extending through said housing wall for mechanically connecting said movable member of said first optional accessory unit and said interrupting mechanism.

2. A circuit interrupter comprising:

a housing including a housing wall wherein said housing has formed in the outer surface of said housing wall a receptacle cavity for receiving therein a first optional accessory unit so that, when said first optional accessory is received in said receptacle cavity, said first optional accessory unit has no substantial portion thereof projecting from the outer surface of the housing wall;

an interrupting mechanism disposed within said housing and including a pair of separable contacts and an operating mechanism for opening and closing said separable contacts;

a first optional accessory unit used in connection with an opening operation of said interrupting mechanism;

fastening means for detachably fastening said first optional accessory unit to an outer surface of said housing wall of said housing; and connecting means extending through said housing wall for operatively connecting said interrupting mechanism within said housing to said first optional accessory unit outside of said housing.

3. A circuit interrupter as claimed in claim 1 wherein said fastening means comprises a slider disposed on at least one of the first optional accessory unit and said housing wall, a guide rail disposed on at least one of the first optional accessory unit and said housing wall and engaging said slider for allowing a sliding movement of said first optional accessory unit parallel to said housing wall only in the direction of extension of said guide rail, and means for preventing said sliding movement of said first optional accessory unit relative to said housing wall.

4. A circuit interrupter as claimed in claim 2 wherein said first optional accessory unit includes a movable member operable in connection with the opening operation of said interrupting mechanism, and said connecting means comprises an operating rod movably extending through said housing wall for mechanically connecting said movable member of said first optional accessory unit and said interrupting mechanism.

5. A circuit interrupter as claimed in any one of claims 2 and 4 wherein said first optional accessory unit is a terminal block connectible to an external electrical circuit, and said connecting means comprises an electrical conductor for electrically connecting said terminal block and said interrupting mechanism.

6. A circuit interrupter as claimed in claim 2 wherein said fastening means comprises a slider disposed on at least one of the first optional accessory unit and said housing wall, a guide rail disposed on at least one of the first optional accessory unit and said housing wall and engaging said slider for allowing a sliding movement of said first optional accessory unit parallel to said housing wall only in the direction of extension of said guide rail, and means for preventing the sliding movement of said first optional accessory unit relative to said housing wall.

7. A circuit interrupter as claimed in claim 4 wherein said fastening means comprises a slider disposed on at least one of the first optional accessory unit and said housing wall, a guide rail disposed on at least one of the first optional accessory unit and said housing wall and engaging said slider for allowing a sliding movement of said first optional accessory unit parallel to said housing wall only in the direction of extension of said guide rail, and means for preventing said sliding movement of said first optional accessory unit relative to said housing wall.

8. A circuit interrupter as claimed in any one of claims 1 to 4 and 6 to 7 wherein said first optional accessory unit comprises a switch operable in response to the opening operation of said interrupting mechanism.

9. A circuit interrupter as claimed in any one of claims 1 to 4 and 6 to 7 wherein said first optional accessory unit includes an insulating housing.

10. A circuit interrupter as claimed in claim 8 wherein said first optional accessory unit includes an insulating housing and wherein said circuit interrupter comprises:

a second optional accessory unit comprising a terminal block used in connection with the opening operation of said interrupting mechanism;

second fastening means for detachably fastening said second optional accessory unit to an outer surface of at least one of the insulating housing of said first optional accessory unit and said housing wall of said circuit interrupter housing; and electrical connecting means extending through said accessory housing for electrically connecting said first optional accessory unit with said second optional accessory unit.

* * * * *